US005791324A

United States Patent [19]

Johnson

[11] Patent Number: 5,791,324

[45] Date of Patent: Aug. 11, 1998

[54] CABLE GUARD AND COMPOUND ARCHERY BOW CONTAINING THE SAME

[76] Inventor: Steven C. Johnson, 23865 Peoria Rd., Harrisburg, Oreg. 97446

[21] Appl. No.: 767,788

[22] Filed: Dec. 17, 1996

[51] Int. Cl.[6] ..... F41B 5/00

[52] U.S. Cl. ..... 124/25.6; 124/88; 124/90

[58] Field of Search ..... 124/25.6, 86, 23.1, 124/88, 89, 90

[56] References Cited

U.S. PATENT DOCUMENTS

| | | | |
|---|---|---|---|
| 4,377,152 | 3/1983 | Saunders | 124/88 |
| 4,452,222 | 6/1984 | Quartino et al. | 124/88 X |
| 4,741,320 | 5/1988 | Wiard | 124/88 X |
| 4,886,038 | 12/1989 | Betters | 124/88 X |
| 4,917,070 | 4/1990 | Townsend | 124/88 X |
| 5,103,798 | 4/1992 | McGraw et al. | 124/88 |
| 5,161,514 | 11/1992 | Cary | 124/88 X |
| 5,178,122 | 1/1993 | Simonds | 124/88 X |
| 5,392,757 | 2/1995 | Head et al. | 124/86 |
| 5,415,149 | 5/1995 | Derus et al. | 124/88 X |
| 5,553,600 | 9/1996 | Miller | 124/86 |

*Primary Examiner*—Tamara L. Graysay
*Assistant Examiner*—Thomas A. Beach
*Attorney, Agent, or Firm*—Donald E. Nist

[57] ABSTRACT

The improved cable guard for a compound archery bow includes an elongated, flexible resilient rod having a rear portion and an opposite front portion, the flexibility of the rod increasing from the front portion to the rear portion. Preferably, the front portion of the rod is generally circular in transverse cross-section while the rear portion of the rod is semi-circular in such cross-section, with a flat side facing away from the bow cables and toward the bowstring. In another embodiment both the front and rear portions of the rod are generally circular in cross-section, but the diameter of the rod decreases from the front portion to the rear portion thereof. The cable guard also includes an elongated transversely extending bracket the medial end of which is adapted to be secured to the rear end of the bow riser while the distal end of the bracket extends laterally of the riser and releasably secures the rod so that its position relative to the bow riser can be adjusted. The rod and bracket can be made of metal, plastic or the like. A fitting can be provided to slidingly receive portions of the bow cables and the rod. The invention also includes a compound archery bow with the cable guard mounted thereon lateral of the bowstring and medial of the cables.

9 Claims, 2 Drawing Sheets

FIG. 1
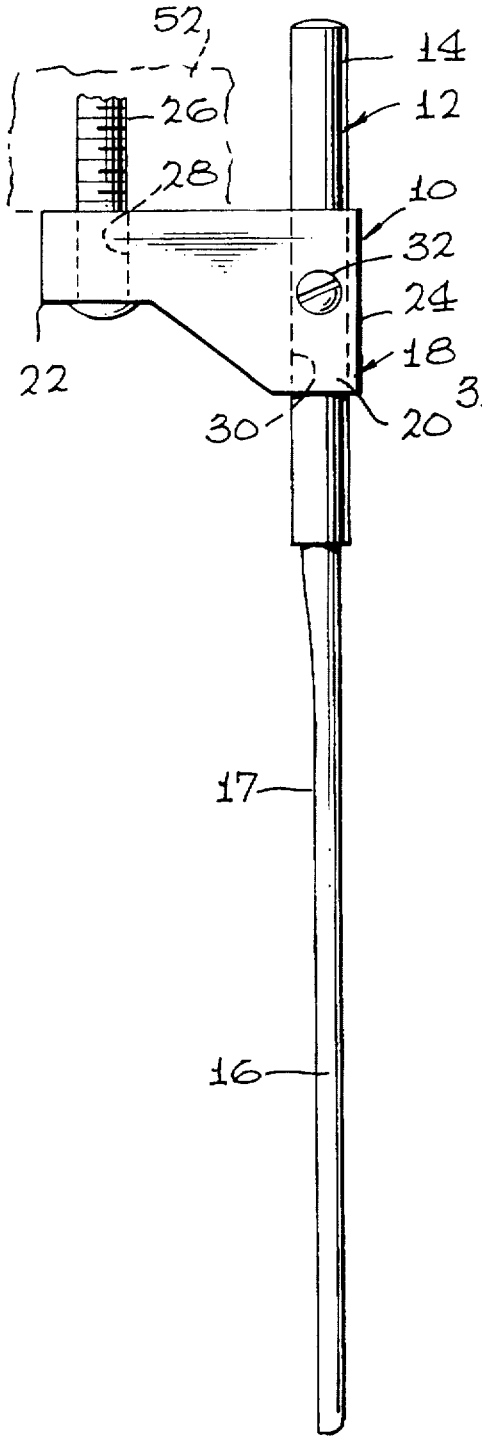
FIG. 2
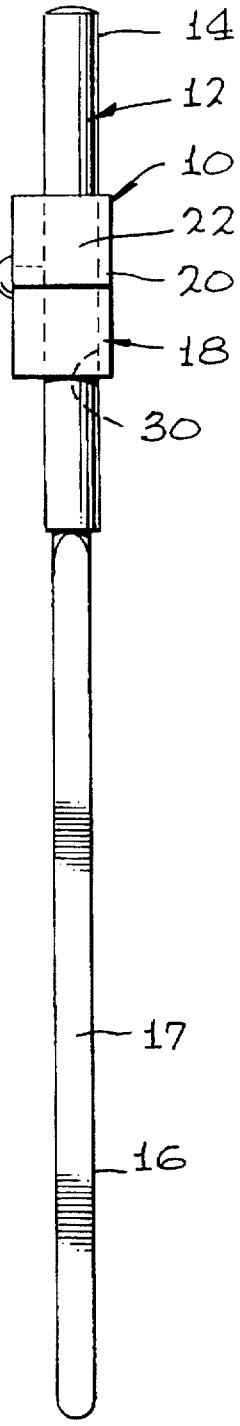
FIG. 7
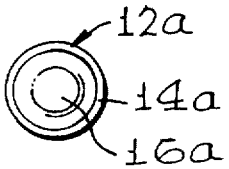
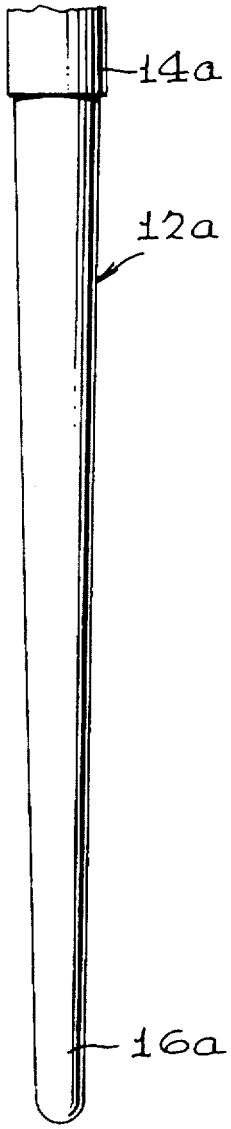
FIG. 8

CABLE GUARD AND COMPOUND ARCHERY BOW CONTAINING THE SAME

BACKGROUND OF THE INVENTION

1. Field of the Invention

The present invention generally relates to sports devices and more particularly to an improved cable guard for a compound archery bow and to the compound bow containing the same.

2. Prior Art

Various types of cable guards have been devised for compound archery bows. The cable guards are inflexible rods which are positioned between the cables of the compound archery bow and the bowstring, torquing the cables out of the path of travel of the bowstring in order to provide necessary clearance for the bowstring and an arrow attached to the bowstring. Since the arrow bears a plurality of feathers or flight vanes at its rear end, the clearance space must be substantial.

Unfortunately, the cable rod keeps the cables torqued to the same degree throughout the process of drawing back the bowstring to the shooting position and firing the arrow by releasing the bowstring. Over a period of time, bow limb distortion and excessive cable wear can and usually does occur, requiring replacement of the cables and, if possible, straightening or costly replacement of the bow limbs. The process of re-cabling is time consuming and difficult, as is bow limb straightening or replacement.

Accordingly, there is a need for an improved type of cable guard which will provide for necessary bowstring and arrow clearance but which reduces bow limb torquing and excessive cable wear. Such improved cable guard should be simple, inexpensive, durable and efficient for its intended purposes.

SUMMARY OF THE INVENTION

The improved cable guard and compound archery bow of the present invention satisfy all the foregoing needs. The cable guard and compound archery bow are substantially as set forth in the ABSTRACT OF THE DISCLOSURE.

Thus, the cable guard comprises, in combination, an elongated rod of unique properties and a bracket for releasably securing the rod to a compound archery bow, in accordance with the present invention. The rod has a front portion and an opposite rear portion and is resilient and flexible, with the flexibility of the rod increasing from its front portion to its rear portion.

In a first preferred embodiment, the front portion of the rod is preferably about circular in transverse cross-section, while the rear portion of the rod is about semi-circular in transverse cross-section. The flat side of the rod is adapted to face the bowstring, providing additional clearance for the bowstring and arrow.

In a second preferred embodiment the rod front portion and the rod rear portion are both generally circular in transverse cross-section, but the rod gradually decreases in diameter from its front portion to its rear portion.

Both embodiments of the rod diminish torque on the bow cables, in contrast to conventional cable guards, because the rod of the present invention is more flexible at its rear protion, where the cables in the resting position contact the rod directly or contact a fitting around the cables on the distal side of the fitting, with the rod contacting the medial side of the fitting. It will be understood that the fitting is not necessary in order to achieve the benefits derived from the rod.

The bracket is designed to hold the rod in a forwardly-rearwardly orientation with respect to the compound archery bow. The bracket is elongated with a medial end adapted to be releasably secured to the rear end of the riser of the compound archery bow, while the distal end of the bracket releasably secures the front portion of the rod in the desired afore-mentioned adjustable orientation with respect to the archery bow.

The bracket extends laterally of the bow to position the rod between the bowstring and the bow cables, torquing the cables out of the path of travel of the bowstring and of an arrow when attached to the bowstring. The forward-rearward position of the rod is adjustable by the bracket, as previously mentioned.

The rod can be inexpensively fabricated of metal, plastic or other suitable material, as can the bracket.

The compound archery bow of the present invention incorporates the improved cable guard installed through the bracket in the proper orientation. Further features of the improved cable guard of the present invention and the compound archery bow incorporating the same are set forth in the following detailed description and accompanying drawings.

DRAWINGS OF THE INVENTION

FIG. 1 is a schematic top plan view of a first preferred embodiment of the improved cable guard of the present invention;

FIG. 2 is a schematic medial side elevation of the cable guard of FIG. 1;

FIG. 7 is a schematic rear elevation of a second preferred embodiment of the rod of the cable guard of the present invention; and, FIG. 8 is a schematic fragmentary top plan view of the rod of FIG. 7.

DETAILED DESCRIPTION OF THE INVENTION

FIGS. 1–6

Figure 3:
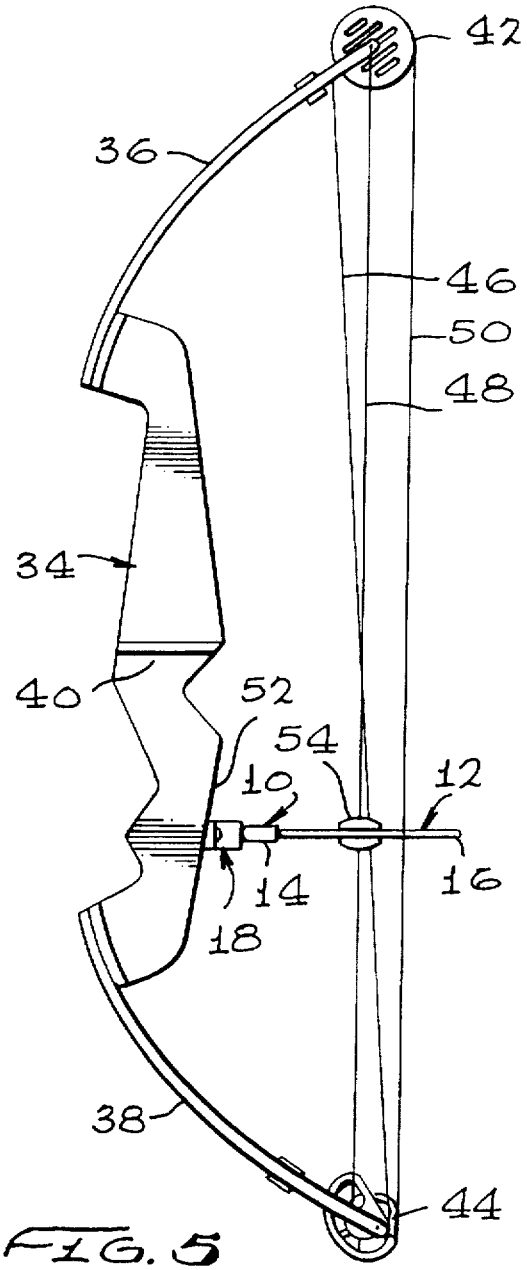
FIG. 3 is a schematic side elevation of a preferred embodiment of the compound archery bow of the present invention, showing the cable guard of FIG. 1 installed thereon, including a cable fitting.
Figure 4:
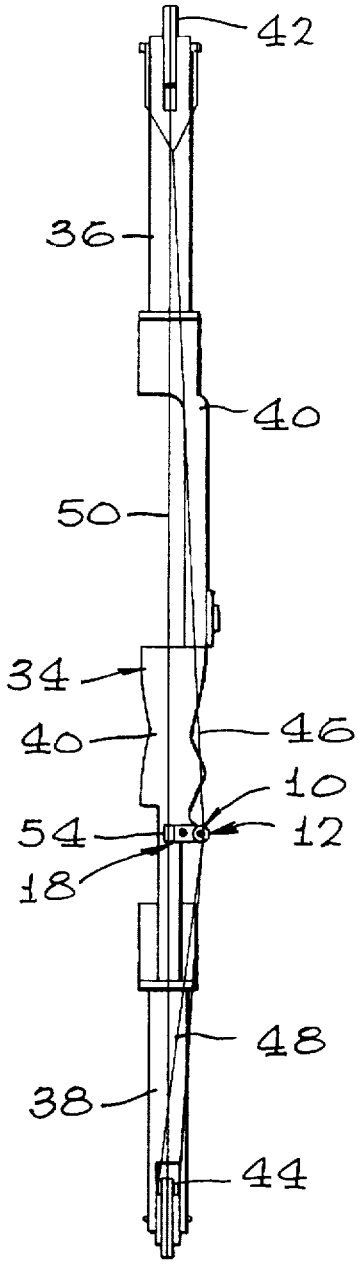
FIG. 4 is a schematic rear elevation of the bow of FIG. 3.

Now referring more particularly to FIGS. 1–6 of the drawings, a first preferred embodiment of the improved cable guard of the present invention is schematically depicted in FIGS. 1 and 2, while FIGS. 3–6 schematically depict a preferred embodiment of the compound archery bow of the present invention, incorporating the cable guard of FIGS. 1 and 2.

Thus, in FIGS. 1 and 2, cable guard 10 is shown, which comprises an elongated rod 12 having a front portion 14 and a rear portion 16. Cable guard 10 also includes an elongated bracket 18. The front portion 14 of rod 12 preferably is about circular in transverse cross-section, while the rear portion 16 of rod 12 preferably is about semi-circular in transverse cross-section with a flat side 17.

Rod 12 increases in flexibility from front portion 14 to rear portion 16 and preferably tapers rearwardly, as shown in FIG. 1. Rod 12 preferably is fabricated from durable, light weight metal, such as aluminum or brass, or a durable plastic, and is flexible and resilient. Rod 12 has increased flexibility in the very area of rod 12 where the cables of a compound bow in the resting position contact it, thus permitting adequate separation of those cables from the bowstring of the bow while reducing bow limb distortion and cable wear and torquing.

Bracket 18 comprises an elongated block 20 having a medial end 22 and an opposite distal end 24. Bracket 18 is adapted to extend laterally of a compound archery bow with medial end 22 secured to the rear end of a compound archery bow riser, as by a threaded bolt 26 passing forwardly through an opening 28 for releasable connection to the bow riser. The distal end 24 of bracket 18 has a a forwardly extending opening 30 adapted to slidingly receive front portion 14 of rod 12 and adjustably releasably secure front portion 14, as by a threaded screw 32 which intercepts front portion 14 in opening 30, as shown in FIG. 2.

Thus, the forward-rearward position of rod 12 in bracket 18 can be readily controlled for optimal positioning of rear portion 16 of rod 12. Preferably, rod 12 is perpendicular to the longitudinal axis of bracket 18. Rod 12 is preferably oriented in bracket 18 so that flat side 17 thereof faces medially, that is, toward the bowstring, thereby providing additional bowstring and arrow clearance, as opposed to conventional cable guards.

Rod 12 and bracket 18 can be made in any suitable size to fit various types of compound archery bows. One such bow forms a part of the present invention, incorporating cable guard 10. Thus, in FIGS. 3–6, a preferred embodiment of the compound archery bow of the present invention is schematically depicted. Bow 34 is shown and includes upper and lower bow limbs 36 and 38 interconnected by a central bow riser 40 and bearing on limb 36 a pulley wheel 42 and on limb 38 a multiple cam 44 interconnected by cables 46 and 48 and a bowstring 50.

Figure 5:
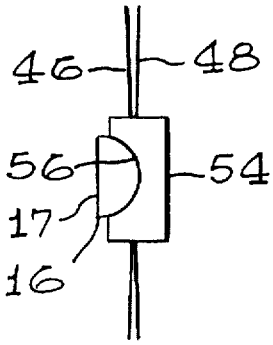
FIG. 5 is an enlarged schematic fragmentary side elevation of the cable guard, fitting and cables of the bow of FIG. 3.
Figure 6:
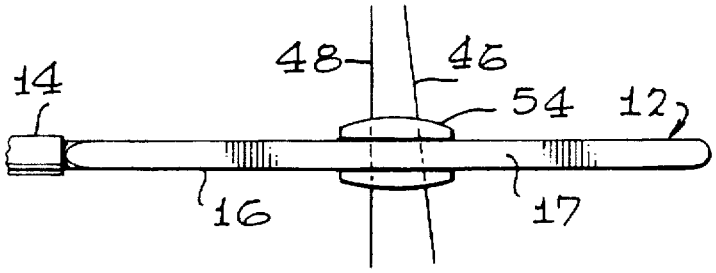
FIG. 6 is an enlarged schematic fragmentary rear elevation of the cable guard, fitting and cables of the bow of FIG. 3.

To the rear surface 52 of riser 40 is connected cable guard 10 through bracket 18 thereof. Rod 12 extends rearwardly of bracket 18 and parallel to the longitudinal axis of bow 34 between bowstring 50 on the medial side of rod 12 and cables 46 and 48 on the distal side of rod 12. Rod 12 rear portion 16 contacts cables 46 and 48 through a fitting 54 which slides on cables 46 and 48 and provides a recess 56 in which rear portion 16 is slidingly disposed (FIGS. 5 and 6).

Rod 12 torques cables 46 and 48 laterally outwardly away from the path of travel of bowstring 50 and an arrow (not shown) when mounted on bowstring 50 for firing from bow 40. Flat side 17 faces bowstring 40 for improved bowstring and arrow clearance during drawing of bowstring 40 and firing of an arrow therefrom. The increased flexibility of rear portion 16, as opposed to front portion 14, of rod 12 assures adequate cable clearance without excessive cable wear or torquing and without excessive twisting of limbs 36 and 38.

Movement of cables 36 and 38 rearwardly during operation of bow 34 causes them to encounter lessened rod-inducing torquing, due to increased flexibility of rear portion 16 of rod 12. This lessened torquing is acceptable because as bowstring drawing proceeds, the fletched end of the arrow on bowstring 50 is remote from cables 46 and 48.

However, when the bowstring 50 is released after full draw and rushes forward, the cable-torquing effect of rod 12 increases, as cables 46 and 48 move forward relative to rod 12 to cause rod 12 to provide the necessary increased clearance for the arrow and its fletching as it is propelled forward by bowstring 50 during firing of the arrow. This is a unique effect and produces the described reduction of strain on the bow and its components, especially when bow 34 is in the resting position.

Accordingly, cable guard 10 and bow 34 incorporating the same provide improved patentable results.

FIGS. 7 and 8

Now referring more particularly to FIGS. 7 and 8 of the accompanying drawings, a second preferred embodiment of the improved cable guard rod of the present invention is schematically depicted. Thus, rod **12*a* is shown, which is substantially identical in all respects to rod 12, except that rod 12*a* has a circular transverse cross-section both at front portion 14*a* thereof and rear portion 16*a* thereof, but tapers uniformly rearwardly so that the diameter of rear portion 16*a* is about one half that of front portion 14*a*. Although rod 12*a* does not have a flat side for additional bowstring and arrow clearance, rod 12*a* increases in flexibility from front portion 14*a* to rear portion 16*a*, as with rod 12, and has the torque-decreasing advantages thereof. Rod 12*a* can be substituted for rod 12 in cable guard 10**, if desired.

Various other modifications, changes, alterations and additions can be made in the improved cable guard and compound archery bow of the present invention, their parameters and components. All such changes, modifications, alterations and additions as are within the scope of the appended claims form part of the present invention.

PRIOR ART STATEMENT

A search of the prior art has not been made relative to the subject matter of the present invention. However, Applicant is aware of a number of cable guards for compound archery bows, all of which are of generally uniform diameter through their length and which are inflexible and stiff.

In contrast thereto, the cable guard of the present invention employs an elongated, flexible resilient rod, the flexibility of which increase from the front portion of the rod to the rear portion of the rod so as not to produce undue wear, torque and strain on the cables of a compound archery bow having such cable guard. Moreover, a preferred embodiment of the improved cable guard has the rear portion of the rod thereof on the side which fades the bowstring flattened in order to assure adequate clearance between the cable rod and the bowstring. In addition, the bracket which holds the rod is adapted to permit the rod to be adjusted in a forwardly and rearwardly position for maximum utility. Accordingly, it is believed the improved cable guard of the present invention and the compound archery bow on which the cable guard is mounted are clearly patentable.

What is claimed is:

1. An improved cable guard for a compound archery bow, said cable guard comprising, in combination:

a) an elongated flexible resilient rod having a rear portion and an opposite front portion, the flexibility of said rod increasing from said front portion toward said rear portion of said rod; and, b) a laterally extending bracket having a first end portion and an opposite second end portion, said bracket first end portion bearing means for releasably connecting said bracket to the rear end of the riser portion of a compound archery bow having a pair of opposed limbs interconnected by said riser portion, each said limb bearing at least one member selected from the group consisting of a pulley and a cam, and cables interconnecting the same, and a bowstring interconnecting said limbs, whereby said second end portion of said bracket extends laterally of said riser portion, said second end portion of said bracket releasably securing said front portion of said rod so that said rear portion of said rod extends rearwardly of said bracket medially of said cables and laterally of said bowstring to prevent cable interference with said bowstring, said front portion of said rod being generally circular in transverse cross-section and said rear portion of said rod being generally semi-circular in transverse cross-section with a flat side which faces medially that is, toward said first portion of said bracket.

2. The improved cable guard of claim 1 wherein said rod is slidingly received in said second end portion of said bracket for adjustably positioning said rod forwardly and rearwardly with respect to said bracket.

3. The improved cable guard of claim 2 wherein said rod is sheathed in a metallic sleeve in said front portion of said rod and wherein said sleeve is releasably pinned in said second end portion of said bracket.

4. The improved cable guard of claim 1 wherein said rod comprises one of metal, plastic and rubber.

5. The improved cable guard of claim 1 wherein said bracket comprises metal and wherein said means for releasably securing said first end portion of said bracket to said riser comprises a threaded bolt extending through an opening in said bracket for threading into said riser.

6. The improved cable guard of claim 1 wherein said guard includes a fitting, the lateral side of which receives a portion of said cables and the medial side of which slidingly abuts said rod, whereby said rod efficiently torques said cables out of the path of said bowstring.

7. A compound archery bow assembly having an improved cable guard, said bow assembly comprising, in combination:

a) a compound archery bow having a pair of spaced limbs, each said limb bearing at least one member selected from the group consisting of a pulley and a cam, and cables interconnecting the same, a central riser portion interconnecting said limbs and a bowstring extending between said limbs and connected to said pulleys and cams; and, b) an improved cable guard device, said device comprising, in combination:

i) an elongated flexible resilient rod having a front portion generally circular in transverse cross-section and a rear portion generally semi-circular in transverse cross-section, with a flat side which faces said bowstring, and, ii) a bracket having a first end portion releasably connected to said riser portion at the rear end thereof and an opposite end portion releasably securing the front portion of said rod, said bracket extending transversely of said bow, with said rod extending rearwardly of said bracket and in a direction parallel to but lateral of the longitudinal axis of said bow and between the bowstring and cables.

8. The improved bow of claim 7 wherein said rod comprises one of metal and plastic.

9. A improved cable guard for a compound archery bow, said cable guard comprising, in combination:

a) an elongated flexible resilient rod having a rear portion and an opposite front portion, the flexibility of said rod increasing from said front portion toward said rear portion of said rod; and, b) a laterally extending bracket having a first end portion and an opposite second end portion, said bracket first end portion bearing means for releasably connecting said bracket to the rear end of the riser portion of a compound archery bow having a pair of opposed limbs interconnected by said riser portion, each said limb bearing at least one member selected from the group consisting of a pulley and a cam, and cables interconnecting the same, and a bowstring interconnecting said limbs, whereby said second end portion of said bracket extends laterally of said riser portion, said second end portion of said bracket releasably securing said front portion of said rod so that said rear portion of said rod extends rearwardly of said bracket medially of said cables and laterally of said bowstring to prevent cable interference with said bowstring, said rod being circular in transverse cross-section, but with the diameter of said rod decreasing from said front portion of said rod to said rear portion of said rod.

* * * * *